United States Patent [19]

Mäkinen et al.

[11] 4,394,164

[45] Jul. 19, 1983

[54] PROCESS FOR REMOVAL OF HARMFUL IMPURITIES FROM METALLURGICAL SULPHIDE MELTS

[75] Inventors: Juho K. Mäkinen, Vanha-Ulvila; Kaarina M. E. Käenniemi, Noormarkku, both of Finland

[73] Assignee: Outokumpu Oy, Outokumpu, Finland

[21] Appl. No.: 305,508

[22] Filed: Sep. 25, 1981

[30] Foreign Application Priority Data

Sep. 26, 1980 [FI] Finland ..... 803052

[51] Int. Cl.[3] ..... C21B 1/04; C22B 1/02

[52] U.S. Cl. ..... 75/21; 75/23

[58] Field of Search ..... 75/21, 23

[56] References Cited

U.S. PATENT DOCUMENTS 3,450,523 6/1969 Socolescir ..... 75/21

*Primary Examiner*—P. D. Rosenberg

*Attorney, Agent, or Firm*—Brooks, Haidt, Haffner & Delahunty

[57] ABSTRACT

A process for the removal of harmful impurities, particularly arsenic, antimony, bismuth and lead, from metallurgical sulphide melts, in which the sulphide melt is sulphurated before conversion, during the slag-blowing stage or after it before the blister-blowing stage, and the melt is refined with nitrogen or other inert gas during sulphuration and possibly after it, so that the amount of sulphur supplied to the sulphide melt is at least 10% in excess of the stoichiometric sulphur amount as calculated from the sulphur requirement of the principal components of the melt.

10 Claims, 1 Drawing Figure

1 Concentrate
2 Lean matte from copper smelting
2A Rich matte from copper smelting
2B Sulphurated rich matte
3A Converter matter
3B Sulphurated converter matte
4 Blister copper

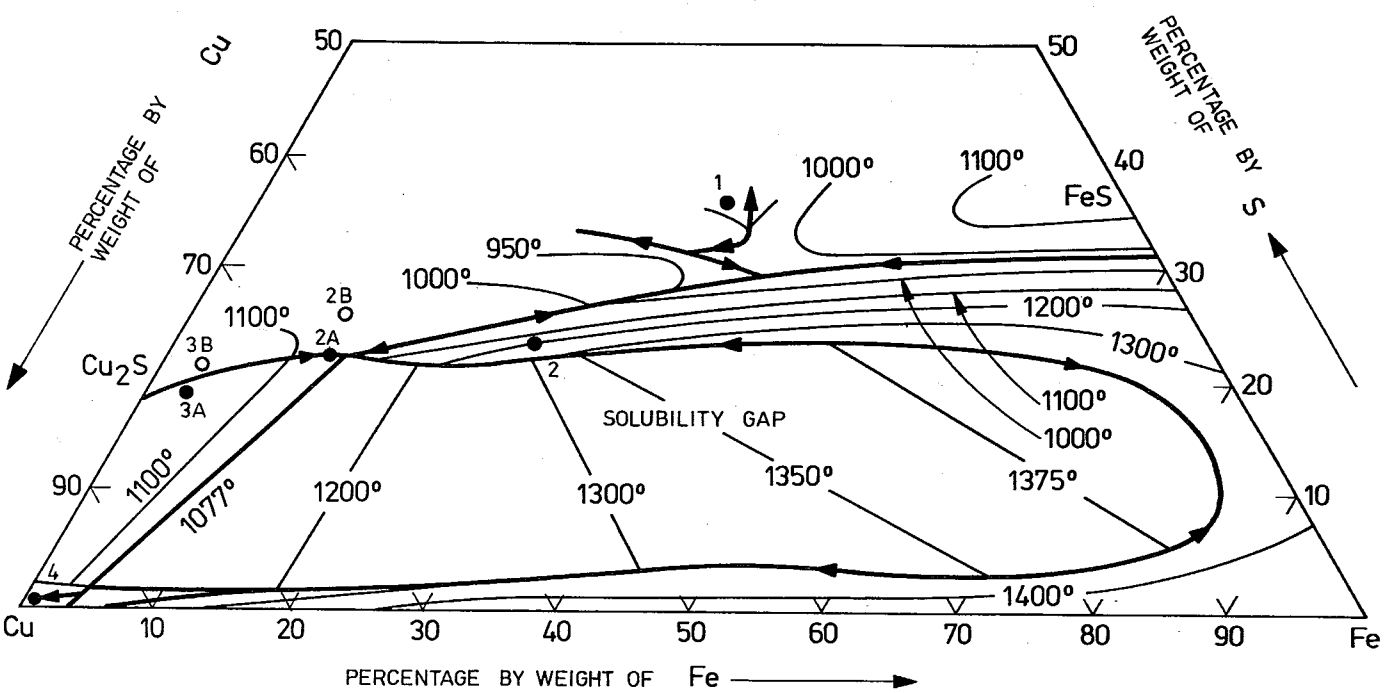
PERCENTAGE BY WEIGHT OF S
PERCENTAGE BY WEIGHT OF Cu
PERCENTAGE BY WEIGHT OF Fe
FeS
Cu2S
SOLUBILITY GAP
1100°
1000°
950°
1200°
1300°
1375°
1350°
1400°
1077°
Cu
Fe
1 Concentrate
2 Lean matte from copper smelting
2A Rich matte from copper smelting
2B Sulphurated rich matte
3A Converter matter
3B Sulphurated converter matte
4 Blister copper

PROCESS FOR REMOVAL OF HARMFUL IMPURITIES FROM METALLURGICAL SULPHIDE MELTS

BACKGROUND OF THE INVENTION

The present invention relates to a process for removal of impurities from impure sulphide melts obtained in pyrometallurgical processing of sulphidic complex and mixed ores or concentrates. By means of the process harmful impurities such as arsenic, antimony, bismuth and lead are removed from sulphide melts containing copper, nickel, cobalt and iron as the main metals.

With resources of pure, easily processed ores becoming exhausted the processing of the afore-mentioned complex and mixed ores has become a necessity. Nevertheless, in processing these raw materials by current methods, so-called harmful impurities follow the main metal through the various process stages to such an extent that the contents of these impurities in the end product exceed permitted limits. Typical impurity contents, for example in raw copper from which conductor copper is produced electrolytically, are: Pb 2000, As 1000, Sb 300, Bi 100 g/t.

Conventional processes for the production of copper (reverberatory furnace and conversion) do not yield sufficiently low impurity contents in respect of arsenic, antimony and bismuth when ores and concentrates containing large amounts of these impurities have to be used. The maximum arsenic content of concentrate is of the order 500–2500 g/t and during the various process stages 50–90% of the impurities can be removed in the slag or volatilized.

In the following some new pyrometallurgical processes are examined which have been developed for the removal of impurities from molten sulphide matte.

The sulphide matte produced when sulphidic concentrates are smelted is usually processed in a converter. In the converter process the elimination of impurities has been improved by means of plant technology, by adjusting the process variables, by changing the composition of the slag and by feeding additives into the converter.

Raising the temperature of conversion improves conditions for the volatilization of impurities. The temperature can be increased by such means as starting the conversion of the copper matte from a "lean" matte, i.e. a matte in which the copper content is low. At the same time the duration of the slag-blowing stage is lengthened and the elimination of volatile components (As, Sb etc.) is improved. The drawback of this method is the large quantities of slag which are produced. The temperature can be raised also e.g. by the addition of coke, which at the same time promotes the volatilization of impurities bound in the slag (e.g. Zn and Pb).

By adjusting the composition of the slag the elimination of secondary components can be increased and selective slagging-off of impurities is possible. Particularly additions of alkaline earthsand alkali oxides to the slag have improved slagging of impurities.

Certain impurities which have not been slagged off or volatilized during slag blowing concentrate in the metallic phase produced during the initial stage of blister blowing. By removing this so-called "first drop" from the converter before continuing blister blowing the impurity content of the principal metal being produced is decreased.

Vacuum treatment is a suitable refining method for both sulphide matte which contains iron and for the so-called converter matte which is obtained after slag blowing. In experiments made on the vacuum processing of converter matte according to the publication Kametani, H., Yamauchi, C., Murao, K., Hayashida, M., Trans. JIM 14, (1973), p. 218–223, elimination of zinc and lead was good and the elimination percentages for antimony and bismuth were in the range 32–76%. Arsenic was not eliminated by vacuum processing from converter matte, but for sulphide matte containing iron the elimination percentages were in the range 64–93%.

Impurity components can be effectively removed from molten sulphide matte by selective chlorination. According to U.S. Pat. No. 3,802,870 nickel matte can be refined by extracting impurities, principally Cu, Co, Cd, Fe, Pb, Mg, Sn and Zn, into a molten salt mixture containing chlorides of metals belonging to group IA or IIA of the periodic system. Nickel chloride or gaseous chlorine is used as the chlorinating agent. The process temperature is in the range 750°–900° C. Because the principal components are Cu, Co and Fe an effort is made to keep the sulphur content of the matte below the stoichiometric sulphur amount as calculated from the sulphur requirement of $Ni_3S_2$. The sulphur content of the matte should be in the range 18–26%.

According to U.S. Pat. No. 3,938,989 arsenic, antimony, bismuth, selenium and tellurium can also be removed from nickel matte by chlorination. These impurities chlorinate as gaseous chlorides which volatilize from the melt. To reduce volatilization of nickel chloride the molten matte is covered by a layer of molten halide. A prerequisite for the elimination by chlorination particularly of arsenic is a high sulphur content in the molten nickel matte. In the patent a minimum sulphur content of 28% is mentioned, preferably the sulphur content is in the range 30–32.5%. The sulphur content of the melt is adjusted using elemental sulphur or hydrogen sulphide before chlorination. The temperature of the chlorination treatment is 750°–1000° C.

Chlorination has been applied in accordance with Finnish Pat. No. 55 357 also to the refining of metal sulphide melts in which there exists a solubility gap between the metal being refined and its sulphide. An example of such a melt is that of copper sulphide. As, Sb, Bi and Pb arise as possible impurities to be removed. The impurities are removed as volatile chlorides by selective chlorination using either gaseous chlorine or a mixture of chlorine and nitrogen in the temperature range 1150°–1250° C. Before chlorination the sulphide melt is saturated with sulphur to move the composition of the melt away from the melt solubility gap. The sulphidation can be carried out using elemental sulphur vapour, hydrogen sulphide, covellite or pyrites. When large amounts of impurities are present the melt must be sulphidated at intervals during the chlorination treatment or chlorination must be carried out using a gaseous mixture containing elemental sulphur so that the composition of the melt remains outside the solubility gap. In this way the activities of copper and its sulphide fall so much that selective chlorination of impurities from the melt is possible. No differences were observed between the impurity contents of unsulphurated and sulphurated converter matte, the impurity contents only being reduced upon chlorination of the sulphurated matte and the impurities consequently escaping as chlorides. In withdrawn Finnish (Pat. Application No. 783186) relating to the chlorination of copper matte and copper nickel matte, Pb, As, Bi, Zn, Sb and Cd are removed by chlorination from the molten matte as volatile chlorides. Copper chloride, nickel chloride or gaseous chlorine is used as the chlorinating agent. To promote the removal of impurities inert gas is blown into the melt after chlorination and possibly during chlorination. Together with chlorine, air can also be blown into the melt. The chlorination treatment is carried out in the temperature range 800°–1200° C. During the whole time of the treatment the layer of molten matte can be covered by a salt melt. Before chlorination the sulphur content of the melt is adjusted so that the sulphur content corresponds to at least 1.05 times the calculated stoichiometric sulphur requirement of the copper, iron, nickel and cobalt. The sulphur content is increased using solid elemental sulphur, sulphur vapour or gas containing sulphur.

Known processes for the removal of impurities are either expensive, because they require separate treatment of fly dust, vacuum treatment of the matte, alkali slagging etc., or else they give rise to occupational health or materials problems, for example as the result of chlorination. Moreover, for example in chlorination treatment considerable quantities of gases containing $SO_2$ and $Cl_2$ are produced and the treatment of these gases by a sulphuric acid plant is difficult.

It is an object of the present invention to provide a process by which a sulphide melt containing large amounts of arsenic and other so-called troublesome impurities can be refined without the aforesaid problems by sulphurating the molten sulphide matte and treating it with inert gas either in the ladle or in the converter. The advantage of this process is low capital cost for plant and low additional running costs, and also that the gases are suitable for the manufacture of sulphuric acid.

SUMMARY OF THE INVENTION

According to the invention the sulphide melt is sulphurated before conversion or during the slag-blowing stage and/or after it before the blister-blowing stage, so that the quantity of sulphur added to the sulphide melt is at least 10% in excess of the stoichiometric sulphur amount as calculated from the sulphur requirement of the principal components of the melt.

Favourable conditions for the removal of impurities are thus created according to the invention by adjusting the sulphur content of the sulphide matte to a level at which the activities of said impurity components are as high as possible. As a consequence of the high activity there is a powerful volatilization of impurities during sulphuration and the inert-gas rinsing which takes place simultaneously with sulphuration or possibly also after it. The elimination of impurities is also improved during the conversion stage after the sulphuration treatment.

DESCRIPTION OF THE DRAWINGS

In FIG. 1 the ternary equilibrium diagram of the system Cu-Fe-S is represented. The solubility gap that occurs in this system will be seen from the figure. A similar solubility gap also exists in the system Cu-Ni-S (Schlitt, W. J., Craig, R. H., Richards, K. J., Met: Trans., (1973), 4, (8), p. 1994–1996). The compositions of ordinary concentrate, matte, converter matte and raw copper have also been marked in the figure with the location of the composition with respect to the solubility gap.

DISCUSSION OF THE THEORETICAL BACKGROUND OF THE INVENTION

For a matte of a composition which is located in the solubility gap both sulphide and metal phases occur in the melt. In practice it has been found that metallic copper occurs, in a state of disequilibrium, also in copper mattes with an apparent composition which is on the boundary of the solubility gap or outside it. Because particularly arsenic, antimony and bismuth have a strong tendency to concentrate in the metal phase (Table 1), the elimination of these impurities from a sulphide matte is most advantageously carried out either before a metallic copper phase has been formed (concentrate, lean copper smelter matte, points 1 and 2 in FIG. 1) or in accordance with the present invention during or after the sulphuration of a matte in which a metal phase has already been formed (rich copper smelter matte, converter matte, points 2B and 3B).

Measured values for the distribution coefficients for As, Sb and Bi between copper and copper matte during conversion are listed in Table 1. In addition the activity coefficients ($\gamma°$) according to Henry's law for arsenic, antimony and bismuth in copper and copper matte and also the vapour pressures (p°) of the pure metals and metal sulphides at a temperature of 1200° C. are given in Table 1.

TABLE 1

Values of some thermodynamic quantities describing the "behaviour" of impurities in copper and copper sulphide at a temperature of 1200° C.

| Element | Distribution coefficient $L = \frac{\text{wt.-\% Me}^{Cu}}{\text{wt.-\% Me}^{matte}}$ | Activity coefficient in copper $\gamma°$ | Activity coefficient in matte* | Vapour pressure $P°_{Me}$ | Vapour pressure $P°_{MexSy}$ (atm) |
|---|---|---|---|---|---|
| As | 5–17 | $5 \cdot 10^{-4}$ | 3<br>20 | $5 \cdot 10^{2}$ | $>>1$ |
| Bi | 7.3 | 2.7 | 10<br>50–90 | $4.2 \cdot 10^{-2}$ | $9 \cdot 10^{-2}$ |
| Sb | 5.5–25 | $1.3 \cdot 10^{-2}$ | 0.3<br>30–40 | $7.9 \cdot 10^{-2}$ | $5 \cdot 10^{-2}$ |

*The higher values are measured for a homogeneous sulphide melt containing iron

Because the impurity components concerned, particularly arsenic, have high vapor pressures as a pure phase, their volatilization from the melt is advantageous. Their actual vapour pressures (p) in a sulphite melt, however, are functions not only of the vapour pressure (p°) of the pure phase but also of the activity coefficient ($\gamma°$) of the component and its content (x, mole fraction) in the melt, as follows:

$$p = x \cdot \gamma° \cdot p°.$$

From the dependence between the activity coefficients and the vapour pressures it is seen that for a constant concentration the tendency of e.g. arsenic to volatilize increases tenfold when it moves from the copper phase to the copper sulphide phase.

DISCUSSION OF THE PREFERRED EMBODIMENTS

In the process according to the invention the activity of the copper is lowered and the activities of the impurities are raised by sulphurating the melt, advantageously using elemental sulphur vapour, so that the composition of the melt is moved and/or remains clearly outside the solubility gap of the system Cu-Fe-S (FIG. 1, points 2B and 3B). The essential point in order to ensure that the thermodynamic conditions for the volatilization of impurities are satisfied is that the molten sulphide matte is sulphurated sufficiently, at least 10% above the stoichiometric sulphur amount as calculated from the sulphur requirement of the main components. It is recommended that for copper smelter matte the sulphur content should be increased to at least 1.10 times, for copper converter matte to 1.10–1.15 times and for mattes with nickel as a principal component to 1.20–1.25 times the stoichiometric sulphur amount as calculated from the sulphur requirement of $Cu_2S$, $Ni_3S_2$ and FeS. Sulphuration can be carried out using compounds containing sulphur such as pyrites, pyrrhotites, covellites or hydrogen sulphide in addition to or in place of elemental sulphur. During sulphuration the melt is rinsed with nitrogen or other inert gas to improve the kinetic conditions for the volatilization of impurities. This gas rinse can, if necessary, continue after sulphuration is finished.

The sulphuration treatment is carried out either before conversion or during the slag-blowing stage and/or after it before the blister-blowing stage and in the temperature range 1100°–1300° C. By means of sulphuration treatment before the slag-blowing and/or blister blowing stages the removal of impurities can be significantly increased also during these blowing stages as a result of the increased activities of the impurities.

If necessary additional heat can be supplied to the system e.g. by burning fossil fuels or by carrying out the gas rinse using hot gas after sulphuration.

The process according to the invention is described in greater detail in the following examples.

EXAMPLE 1

As an application of the invention the sulphuration refining of copper converter matte is examined. The sulphuration treatment is carried out in the converter after the so-called slag-blowing stage. During the slag-blowing stage most of the iron present in the flash-smelted copper matte was oxidized to slag. The slag produced was removed from the surface of the molten converter matte. The amount of the converter matte was approx. 50 t and the temperature 1250° C.

Elemental sulphur vapour (temp. 400° C.) from a separate sulphur furnace was blown into the converter matte with nitrogen being used as a carrier gas. The amount of sulphur used was 42.2 kg per tonne of converter matte and the percentage transferred to the matte was 87%.

The effect of sulphuration treatment for half an hour on the analysis of the matte is seen from Table 2. The material balance and heat balance for the sulphuration refining are also given in the table. The melt was sulphurated to approx. 11% above the stoichiometric sulphur amount as calculated from the sulphur requirement of $Cu_2S$, FeS and $Ni_3S_2$.

After sulphuration the molten converter matte was rinsed for 30 min. with gaseous nitrogen, the amount of nitrogen being 25 l/min and the temperature 400° C. When the treatment finished the temperature of the melt was 1250° C.

The effect of the sulphuration treatment was greatest in respect of the arsenic content of the matte. During the sulphuration and gas rinse the arsenic content fell from 0.79% to 0.07%.

TABLE 2

Material balance, heat balance and analyses of sulphuration refining of copper converter matte.

| Material and heat balances | Amount t, $Nm^3$ | Temperature °C. | Heat content MJ |
|---|---|---|---|
| Inputs | | | |
| Converter matte | 50 | 1250 | 39600 |
| Sulphur | 2.1 | 400 | 450 |
| Nitrogen | 1500 | 400 | 750 |
| | | Total | 40800 |
| Products | | | |
| Sulphurated converter matte | 50 | 1250 | 40000 |
| Dust | 2.1 | 1250 | 2200 |
| Nitrogen | 1500 | 1250 | 2600 |
| Heat of reaction | | | −6700 |
| Heat losses | | | 2700 |
| | | Total | 40800 |

| Material analyzed | Analysis wt.-% | | | | | | | | | |
|---|---|---|---|---|---|---|---|---|---|---|
| | Cu | Fe | S | Ni | Co | Zn | Pb | As | Sb | Bi |
| Converter matte at input | 72.3 | 3.6 | 20.0 | 1.3 | 0.03 | 0.12 | 1.2 | 0.79 | 0.20 | 0.08 |
| Sulphurated converter matte | 70.6 | 3.5 | 22.6 | 1.3 | 0.03 | 0.12 | 1.2 | 0.30 | 0.16 | 0.06 |
| Gas-rinsed converter matte | 72.2 | 3.6 | 21.1 | 1.3 | 0.03 | 0.11 | 1.1 | 0.07 | 0.11 | 0.04 |

EXAMPLE 2

In the conversion of copper matte a distinction is made between the slag-blowing and the blister-blowing stage. In the blister-blowing stage the iron still remaining in the converter matte is slagged off and the sulphur is oxidized to $SO_2$. The effect of sulphuration treatment on the elimination of impurities during the blister-blowing stage was examined in a series of laboratory experiments.

Melts were made with 5 kg charges in $Al_2O_3$ crucibles using a silite resistance furnace. The molten converter matte, temp. 1200° C., was converted to blister copper by blowing pure oxygen into the melt. In some of the melts the converter matte was sulphurated and the melt was rinsed with inert gas before blister blowing.

In Table 3 analyses are given for two individual melts at different stages of the processes. In melt B blister blowing was preceded by sulphuration and rinsing with nitrogen, in melt A the molten converter matte was converted directly to blister copper without pre-treatment.

The results show that by sulphuration the arsenic content of blister copper can be reduced to approximately one twentieth of that in blister copper processed in the normal way, and correspondingly the contents of Bi and Sb to approximately one third. Thus by means of the sulphuration treatment blister copper is obtained directly which is suitable for electrolysis even when the initial impurities of the matte are high.

TABLE 3

Conversion of copper converter matte to blister copper
A = without sulphuration treatment
B = with sulphuration treatment after slag blowing

| | Analysis wt % | | | | | | | | | |
|---|---|---|---|---|---|---|---|---|---|---|
| | Cu | Fe | S | Ni | Co | Zn | Pb | As | Sb | Bi |
| Case A | | | | | | | | | | |
| Stage analyzed | | | | | | | | | | |
| Input material, converter matte | 72.6 | 3.2 | 20.0 | 1.4 | 0.03 | 0.11 | 1.4 | 0.81 | 0.19 | 0.06 |
| Product, blister copper | 97.7 | <0.005 | <0.02 | 0.39 | <0.005 | 0.002 | 0.06 | 0.89 | 0.09 | 0.07 |
| Case B | | | | | | | | | | |
| Stage analyzed | | | | | | | | | | |
| Input material, converter matte | 72.0 | 3.4 | 19.9 | 1.3 | 0.03 | 0.13 | 1.4 | 0.70 | 0.15 | 0.04 |
| Converter matte after sulphuration treatment | 70.9 | 3.4 | 21.4 | 1.3 | 0.03 | 0.12 | 1.3 | 0.06 | 0.07 | 0.02 |
| Product, blister copper | 98.3 | 0.009 | 0.01 | 0.44 | <0.005 | 0.001 | 0.06 | 0.05 | 0.03 | 0.02 |

EXAMPLE 3

With sulphide matte containing large amounts of nickel the sulphur content of the melt must be raised sufficiently high to ensure the elimination of impurities, particularly of As. This was also apparent from experiments in which 1 kg charges of Cu-Ni converter matte were melted and treated with various amounts of sulphur and nitrogen at 1250° C.

The results obtained are shown in Table 4. The input material was the same for all the melts.

In melt 1 the amount of sulphur after sulphuration was approx. 80% of the stoichiometric sulphur amount (as calculated from the sulphur requirement of $Cu_2S$, $Ni_3S_2$ and FeS). The activity of the arsenic remained low and the arsenic did not volatilize from the matte due to the presence of a metallic Cu-Ni phase.

In melt 2 the sulphur content of the matte exceeded the stoichiometric sulphur amount by 10%. It is seen from the results of the analysis that the activity of the As is increased and the arsenic content is slightly lower.

Significant elimination of arsenic during sulphuration refining was only achieved in melt 3, in which by prolonged sulphuration the sulphur content of the melt was increased to 20% above the stoichiometric amount.

TABLE 4

Sulphuration treatment of Cu—Ni converter matte with different amounts of sulphur.
Input material: Cu 21.5%, Ni 55.0%, Fe 1.9%

| | Analysis wt. % | |
|---|---|---|
| | S | As |
| Melt 1 30 min. sulphuration + 60 min. $N_2$ rinse | | |
| Initial content | 17.9 | 0.56 |
| After sulphuration | 20.8 | 0.55 |
| After nitrogen rinse | 20.5 | 0.55 |
| Melt 2 60 min. sulphuration + 60 min. $N_2$ rinse | | |
| Initial content | 17.9 | 0.57 |
| After sulphuration | 26.0 | 0.52 |
| After nitrogen rinse | 25.4 | 0.49 |
| Melt 3 90 min. sulphuration + 60 min. $N_2$ rinse | | |
| Initial content | 17.9 | 0.57 |
| After sulphuration | 27.9 | 0.38 |
| After nitrogen rinse | 26.2 | 0.30 |

EXAMPLE 4

In this example the sulphuration treatment of copper matte before conversion is examined together with the effect of sulphuration on the volatilization of impurities during the slag-blowing and blister-blowing stages.

The concentrate, which contained large amounts of impurities (As 1.7%, Sb 0.07% and Bi 0.08%), was smelted in a flash smelting furnace. The resulting copper matte was tapped off at intervals into 15 tonne vessels in which it was treated with elemental sulphur vapour and nitrogen before being loaded into the converter.

The effect of the sulphuration refining on the analysis of the matte is shown in Table 5. In the course of the sulphuration treatment the As content of the matte decreased by 80%, the Sb content by 40% and the Bi content by approx. 30%.

After sulphuration and gas rinsing the matte was loaded into the converter where slag blowing and blister blowing were carried out. The average analysis obtained for the blister copper was: Cu 98.1%, Fe 0.01%, S<0.01%, Ni 0.37%, Co 0.01%, Zn 0.001%, Pb 0.02%, As 0.08%, Sb 0.009% and Bi 0.01%.

When the same concentrate was processed according to normal practice without sulphuration, the As content of the blister copper was 0.8%, the Sb content 0.04% and the Bi content 0.05%.

TABLE 5

| Stage analyzed | Sulphuration treatment of copper matte from a flash smelting furnace | | | | | | | | | |
|---|---|---|---|---|---|---|---|---|---|---|
| | Analysis wt. % | | | | | | | | | |
| | CU | Fe | S | Ni | Co | Zn | Pb | As | Sb | Bi |
| Input material copper matte | 66.4 | 9.4 | 20.1 | 0.41 | 0.15 | 0.76 | 0.56 | 1.9 | 0.04 | 0.14 |
| Sulphurated copper matte | 64.2 | 9.4 | 22.6 | 0.38 | 0.15 | 0.76 | 0.43 | 0.35 | 0.025 | 0.10 |

EXAMPLE 5

A series of trials was made to determine the amount of sulphur required to eliminate impurities from copper converter matte.

The sulphuration was performed in laboratory conditions using 15 minute sulphuration periods. The success of the sulphuration was checked by the changes in the arsenic content of the matte.

The results are given in Table 6. From the results it can be stated that once the sulphur content exceeds a certain critical limit the As content starts to fall sharply. Such a sulphur content is reached by sulphur values which exceed stoichiometric sulphur amount by approx. 6–7%.

TABLE 6

Sulphuration of copper converter matte by different amounts of sulphur
Initial material: Cu 71.9%, Fe 3.6%, Ni 1.3%

| | Analysis wt. % | | Sulphur amount |
|---|---|---|---|
| | S | As | % of stoichiometric |
| Initial content | 19.7 | 0.78 | 95 |
| 15 min. sulphuration | 20.6 | 0.76 | 101 |
| 30 min. sulphuration | 21.4 | 0.71 | 106 |
| 45 min. sulphuration | 21.9 | 0.52 | 109 |
| 60 min. sulphuration | 22.5 | 0.10 | 113 |

What is claimed is:

1. A process for the removal from metallurgical sulphide melts of harmful impurities selected from the group consisting essentially of arsenic, antimony, bismuth and lead, comprising sulphurating the sulphide melt in an inert gas atmosphere by feeding into the melt a sulphur containing agent in an amount such that the sulphur supplied to the sulphide melt is at least 10% in excess of the stoichiometric sulphur amount as calculated from the sulphur requirement of the principal components of the melt.

2. A process according to claim 1, in which the sulphur containing agent is elemental sulphur vapour.

3. A process according to claim 1, in which the sulphur containing agent is a compound selected from the group consisting essentially of pyrites, pyrrhotites, covellite and hydrogen sulphide.

4. A process according to claim 1, in which the temperature of the melt is held in the range 1100°–1300° C. during sulphuration.

5. A process according to claim 1, in which, in sulphurating copper converter matte, the amount of sulphur is raised 10–15% above the stoichiometric sulphur amount as calculated from the sulphur requirement of $CU_2S$, $Ni_3S_2$ and FeS.

6. A process according to claim 1, in which, in sulphurating matte containing nickel as the principal component, the amount of sulphur is raised 20–25% above the stoichiometric sulphur amount as calculated from the sulphur requirement of $CU_2S$, $Ni_3S_2$ and FeS.

7. A process according to claim 1, in which additional heat is supplied to the melt while carrying out an inert gas rinse using hot gas after sulphuration.

8. A process according to claim 1, in which the sulphide melt sulphurated contains as the principal metal one or more of copper, nickel, cobalt and iron.

9. A process according to claim 1 in which the melt is converted before or after sulphuration.

10. A process according to claim 9, wherein slag is blown in a slag-blowing stage before or during the sulphuration.

* * * * *